United States Patent [19]

Asel et al.

[11] 4,020,983

[45] May 3, 1977

[54] APPARATUS FOR JOINING A BUCKLE TO A TAPE

[75] Inventors: John R. Asel, Lorraine; Roger Allaire, St. Leonard; Peter Thalmann, Lachine; Rene Castonguay, Montreal, all of Canada

[73] Assignee: Canadian Lady-Canadelle Inc., W. Montreal, Canada

[22] Filed: Apr. 22, 1976

[21] Appl. No.: 679,423

[30] Foreign Application Priority Data

May 14, 1975 United Kingdom ..... 20441/75

[52] U.S. Cl. ..... 223/49; 112/104; 112/121.15; 112/121.27

[51] Int. Cl.[2] ..... A41H 43/00

[58] Field of Search ..... 112/104, 121.15, 121.12, 112/121.27, 121.25, 27, 86, 102, 265; 223/1, 49

[56] References Cited

UNITED STATES PATENTS

| | | | |
|---|---|---|---|
| 2,770,204 | 11/1956 | Brownstein | 223/49 X |
| 2,955,730 | 10/1960 | Sonntag et al. | 223/49 |
| 3,150,804 | 9/1964 | Edelman | 223/49 |
| 3,497,116 | 2/1970 | Herron et al. | 223/49 |

*Primary Examiner*—G. V. Larkin
*Attorney, Agent, or Firm*—Beveridge, DeGrandi, Kline & Lunsford

[57] ABSTRACT

Apparatus for forming a component of shoulder straps for ladies garments, including a tape with a two-slot buckle sewn onto one end. A feature of the apparatus is a pivotable buckle holding and transfer device arranged to receive horizontal buckles at a delivery point and pivotable through about a right angle to move the buckles from the delivery point to a threading position adjacent the operative part of a sewing machine in which latter position the buckles are disposed vertically. Threading means are provided for advancing a free end of tape past the operative part of the sewing machine and through one slot in the vertically held buckle, and bending means are provided for bending the free end of tape towards the other slot in the buckle. Blade means are provided for pushing the free end of tape through the other slot in the buckle and into a position adjacent the main part of tape extending from the buckle, so that adjacent parts of the tape are suitably positioned for sewing together around the central part of the buckle.

10 Claims, 13 Drawing Figures

SEE FIG-3A
4
14
14a
281
281a
42
267
228
226
260
272
44
46
262
244
224
237
237a
239
220
235
221
230
257
255
252
252a
48
45
40
264
250
287
288
38
200
202
206
212b
207
282
283
280
274
270
284
14
14a

APPARATUS FOR JOINING A BUCKLE TO A TAPE

The present invention relates to devices and apparatus for forming components of shoulder strap for ladies garments particularly brassieres. Such a shoulder strap is formed of two parts united together, namely a first strap portion comprising a first tape with a buckle (or so-called slide) secured to one end, and a second strap portion comprising a second tape having a ring secured thereto, the two strap portions being united by passing a free end of the first tape through the ring and then back through the two slots of the buckle. A strap of this kind, which is well known in the art, will be referred to hereinafter as being "of the type described." The first tape is preferably inelastic, and the second tape is preferably elastic.

The buckle and ring are conventionally secured to their respective strap portions by sewing together a main portion of the respective tape and an end portion thereof after the latter portion has been passed through the two slots of the buckle or through the ring as appropriate. However, instead of sewing, an ultrasonic welding step may be used with appropriate synthetic fabrics. The term "joining machine" will be used to signify either a sewing machine or another type of machine, for example an ultrasonic welding machine, which can join together two parts of a tape.

Manufacture of these shoulder straps has hitherto involved much manual labour. The only machine known to applicants which manufactures shoulder straps of this type is the machine shown in U.S. Pat. No. 3,497,116 to Herron et al, which issued Feb. 24th, 1970. The Herron machine is complicated, and is understood to be not entirely satisfactory in operation. The present invention is concerned with a machine which is different from that of the Herron machine in very many ways. One particular difference lies in the arrangement used to unite the two parts of the strap together when these have been formed in different parts of the machine; this arrangement is the subject of our U.S. Pat. application No. 679,424 filed concurrently herewith.

The aforesaid application relates principally to operations relating to the uniting of the strap portions which occur in a third section of the machine. The present invention is concerned with a first section of the machine which forms the first strap portion, and which could be used, if desired, quite independently to produce the first strap portion, without any means for uniting the two portions.

Thus, in accordance with one aspect of the invention, apparatus for securing a two-slot buckle onto a tape includes means for supplying horizontally disposed buckles to a delivery point, a pivotable buckle holding and transfer device arranged to receive said buckles at said delivery point and pivotable through about a right angle to move the buckles from the delivery point to a threading position adjacent the operative part of a joining machine, in which threading position the buckles are disposed vertically, threading means for holding and advancing a free end of tape past the operative part of the joining machine and through one slot in the vertically held buckle, bending means for bending the said free end of the tape towards the other slot in the buckle, and blade means for pushing the free end of the tape through the other slot in the buckle and into a position adjacent the main part of the tape extending from the buckle, so that said adjacent parts of the tape are positioned in the operative part of the joining machine to allow said free end to be joined to the main part of the tape by said machine.

The threading means is preferably a horizontally movable carriage supporting a pair of elongated clamping elements capable of advancing the free end of the tape lengthwise through said one slot in the buckle. The carriage may be associated with knife means operable when the threading means is in the retracted position to sever the tape at a point adjacent the end of the clamping elements nearest the holding and transfer device. The knife, and the retracted position of the threading means, may be movable to vary the length of tape in the first strap portion cut off by the knife.

Further in accordance with the invention, a method for securing a two slot buckle to a tape includes the steps of:

- horizontally feeding a horizontally disposed buckle to a buckle holding and transfer device,
- rotating said buckle through about a right angle and simultaneously moving said buckle to a position near the operative part of a joining machine,
- threading tape endwise through the operative part of the joining machine and through one slot in the buckle,
- bending the free end of the tape towards the other slot of the buckle,
- tucking the free end of the tape through the other slot of the buckle to overlap the main length of tape in the operative part of the joining machine, and
- operating said joining machine to join together the overlapping tape parts.

A specific embodiment of the present invention will now be described by way of example with reference to the accompanying drawings, which show general views of the whole machine and detailed views of a first strap forming section, and in which:

FIGS. 1A and 1B show respectively plan and side views of a completed shoulder strap as formed by the machine, FIG. 2 shows a diagrammatic plan view of the whole machine taken on a plane just above the level occupied by the first and second tape during most of the machine operations, this drawing showing the division of the machine into the main sections A, B and C, FIGS. 3A and 3B show overall detail plan view of the left hand portions and right hand portions of the machine, respectively, FIGS. 4A and 4B are front elevations of the machine taken along lines 4—4 FIGS. 3A and 3B respectively and showing the main components of sections A and B, FIG. 5 shows a perspective view of the left hand part of section A of the machine (as seen from the front) showing the parts in broken lines in a first position and in full lines in a second position, FIG. 6 shows a perspective view of the right hand part of section A of the machine (as seen from the front), with parts in a first position, FIG. 7 is a plan view of section A with the parts in the second position, FIG. 8 is an elevational view on lines 8—8 of FIG. 7 with parts in the second position, FIG. 9 is an enlarged elevational view of a buckle holding and transfer device of section A in its second position, and FIG. 10 is a view of the same holding and transfer device on lines 10—10 of FIG. 9.

The general features of the whole machine will firstly be described as a background to the detailed description of parts in accordance with this invention.

BRIEF SUMMARY OF MAIN COMPONENTS AND OPERATION OF MACHINE

The machine is designed to produce shoulder straps for brassieres, as illustrated in FIG. 1. The strap includes a first strap portion comprising a first tape 10 which is substantially inextensible and which preferably comprises an outer envelope of smooth polyester fabric which encloses a strong fabric strip. This tape has a buckle 12 sewn onto one end, by the tape having been passed through two slots in the buckle and sewn back onto itself along a seam about one-half inch from the buckle. The second strap portion comprises a second elastic tape 14 which has had its end passed through a ring 16 and been sewn back onto itself along a seam about one-half inch from the ring. The two strap portions are united by the first tape having been passed through the ring and then through both slots of the buckle and pulled out to suitably position the buckle.

The basic components and operation of the machine will firstly be described in general terms with reference to FIGS. 2 and 3. These figures illustrate the three main sections into which the machine may be divided, namely a first section A which forms the first strap portion with the buckle, and second section B which forms the second (elastic) strap portion with the ring, and section C which unites these parts together to form the completed shoulder strap assembly.

In section A, with which the present invention is concerned, tape 10 is supplied by a spool 20, and buckles 12 are supplied (orientated horizontally) by a magazine assembly 22. The buckles are moved from the supply position (shown in broken lines) to a vertical threading position (shown in full lines) adjacent the bed of a sewing machine 24 by means of a pivotable holding and transfer device indicated at 26. The tape material 10 is fed endwise along a horizontal path between the open blades of a knife 28 by a socalled picker 30. This picker is movable horizontally and has thin blade-like clamping members which thread the end of the tape through the upper slot in a vertically disposed buckle held in the threading position by the device 26. The projecting outer end of the tape 10 is then locked in position relative to the buckle by a locking member indicated at 31, to allow the picker to withdraw, and the free end of the tape is bent downwardly across the central area of the buckle by an air blast from the tube 32. The bent end is then tucked back through the lower slot in the buckle by a horizontally movable blade 34 into a position under the main part of the tape and situated for sewing onto this main part by sewing machine 24. The projecting end of the tape is then sewn to the main portion by the sewing machine 24.

In section B meanwhile, a ring 16 is transferred from magazine assembly 38 to a ring holding and transfer device 40 which holds the ring horizontally. The elastic tape 14 is then fed endwise from supply spool 42 by picker 44 which moves the tape between the open blades of knife 46 to a position in which an end portion of the tape overlies the ring 16. The path of movement of the tape is parallel to but spaced from the initial path of movement of tape 10 in section A. The end portion of the tape is then punched through the ring 16 by a downwardly operating punch moved by an air cylinder shown at 45 in FIG. 3B. Then the picker 44 withdraws after releasing the tape. Ring 16 is then moved horizontally by the device 40 over the bed of a sewing machine 48, in such manner that the projecting end of the tape is folded back under the main portion of the tape so that the machine can then be operated to sew the two portions of tape together around the ring. After sewing, the knife 46 is operated to sever a suitable length of elastic which remains attached to the ring, and the ring 16 with the tape attached is moved into the holding position shown at 40X in FIG. 3, the ring being simultaneously rotated to the vertical position with the tape 14 hanging from its lower side.

Turning to section C, the main operative parts of this section are the clamping devices 50 and 51. Both of these are monted for translational movement towards and away from section A, and when the sewing operation has been completed in section A these clamping devices advance together to grip the tape 10. The first device 50 clamps the tape 10 adjacent the buckle 12, and the second device 51 clamps the tape just to the left hand side of knife 28, which is then operated to sever the tape 10. The device 51 has a narrow projecting end which extends (in the advanced position of device 51) away from buckle 12, and is suitable for threading the free end of the tape 10 both through the ring 16 and through a slot in the buckle, as will be described. The devices 50 and 51 then withdraw together to bring the tape into alignment with the original direction of movement of the elastic tape 14 and of ring 16 so that the projecting end of tape 10 is suitably aligned with the ring 16, which can then be moved onto the end of the tape by further movement of device 40 along the same path which this device moved in transferring the ring from the first position to the sewing position. The device 40 then releases the ring. Then, the clamping device 51 simultaneously rotates through 180 degrees and moves towards the device 50 to bring the projecting end of the tape 10 under the main portion of this tape, and final movement of device 51 inserts the projecting end of the tape through the lower slot of buckle 12. The end of tape 10 is then pushed upwardly by part 53 of a buckling device indicated generally at 54, and is tucked back through the upper buckle slot by a pneumatically operated blade 55 which is also part of the buckling device. A pulling device 57 (shown in FIG. 3A) mounted on an inclined slideway then grasps the projecting end of the tape 10 pulling a suitable amount through the buckle to give the final strap shown in FIG. 1. The completed strap is then removed by the ejector 59.

All movements described are caused by pneumatic cylinders, operated automatically.

In the detailed description which follows, reference will be made to lateral (leftward and rightward) directions, and fore and aft (forward and rearward) directions; these will be understood as directions in horizontal planes, with lateral directions being from side to side of the machine (parallel to the main paths of tape movement), and fore and aft directions being perpendicular thereto. A forwards direction will be understood as meaning towards the front of the machine which is at the bottom in the plan views.

DETAILED DESCRIPTION OF SECTION A OF MACHINE

Figure 7:
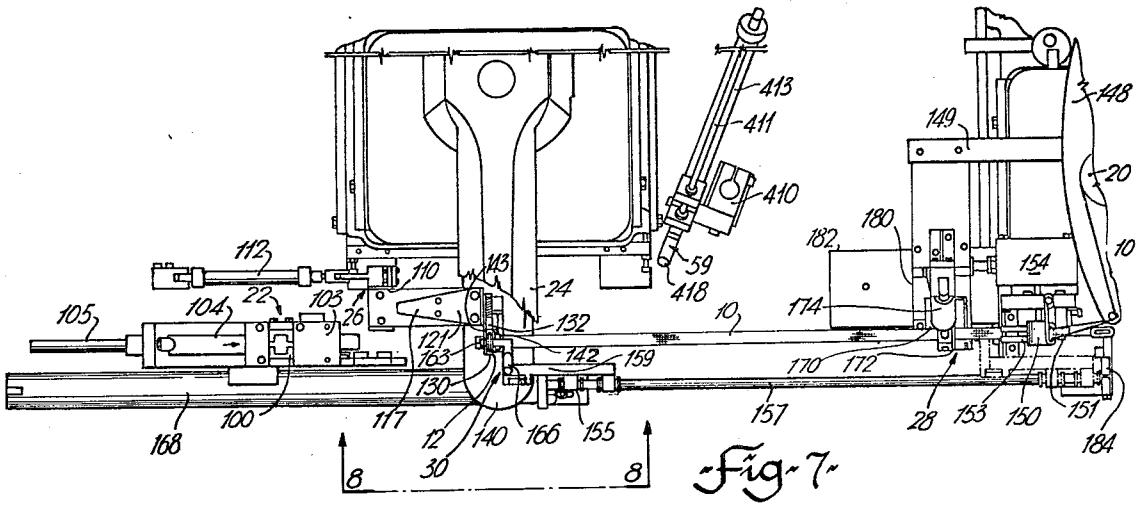
Figure 8:
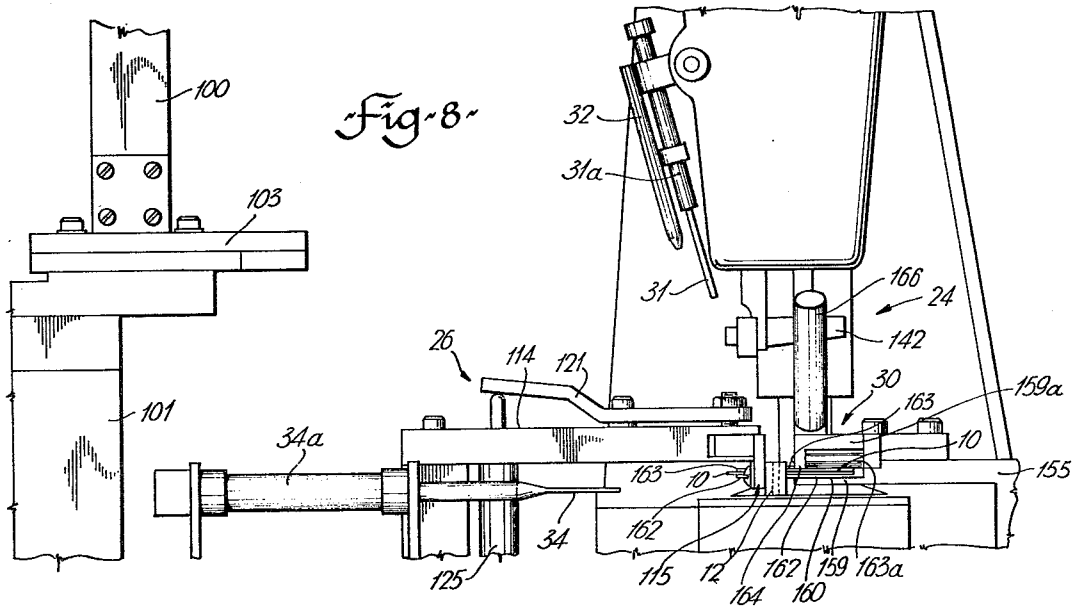
Figure 9:
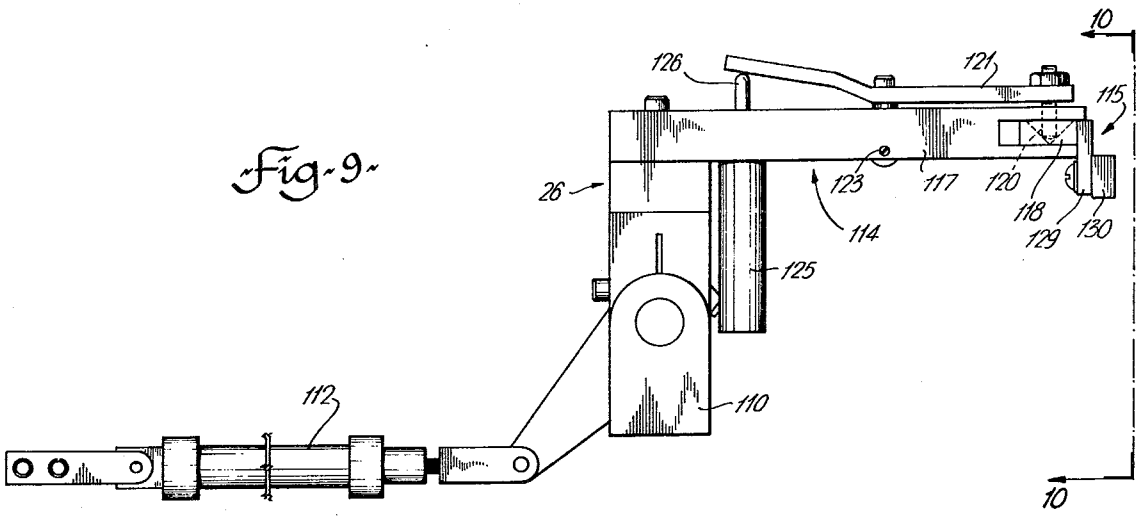
Figure 10:
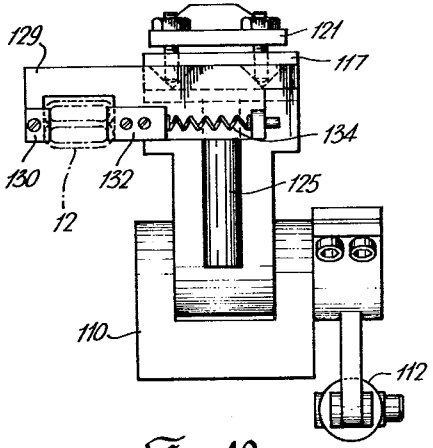

The left hand part of section A of the machine, which is particularly shown in FIGS. 5 to 7 and 8, and of which a component is shown in FIGS. 9 and 10, will now be described in detail.

The magazine assembly 22 for the buckles 12 includes a vertical tube 100 in which the buckles are vertically stacked. This tube is mounted by means of a bracket 101 attached to the machine bed and by a buckle supply assembly including two plates 103 which between them form a horizontal laterally extending passageway for horizontally disposed buckles which are pushed out of the magazine to a delivery point at the end of the passageway by a blade 104 operated by a pneumatic cylinder 105. The buckles in the tube 100 are urged downwardly by a weight to position them at the front end of blade 104.

The buckles leaving the magazine pass into the buckle holding and transfer device 26, which is shown in best detail in FIGS. 9 and 10. This device is mounted on a bracket 110 for pivotal movement about a horizontal fore and aft axis, and the device is movable by a pneumatic cylinder 112 from a generally vertical first (buckle receiving) position, indicated in FIG. 5, to a generally horizontal second threading position shown in FIGS. 5, 7, 8, 9, and 10. This device allows buckles to be positioned vertically adjacent the operative part of the sewing machine (between the sewing foot and the bed) without there being any attachments made to the sewing machine bed, and in fact without there being any direct contact between the buckle holding device and the sewing machine.

The buckle holding and transfer device includes a main body part 114 which is directly, pivotally attached to bracket 110, and a buckle holder part 115 which, under circumstances to be described, is movable relative to part 114; this aspect of the device is the subject of co-pending U.S. Pat. application Ser. No. 679,424 filed concurrently herewith. Part 114 includes a box portion 117 having at its outer end a parallel sided recess in which is slideable a parallel sided lug 118 of the holder part, best shown in FIG. 9. The sides of lug 118 are parallel to the major surfaces of box part 117, so that when the device is in its second position as shown in FIG. 9 the holder part can move horizontally by the sliding of the lug 118 in its recess. Lug 118 can however be locked in position by two pins 120, shown by broken lines in FIG. 9, which are mounted at the outer end of a plate 121. This plate is pivoted centrally of the box part 117 at pivot 123, and is movable by a pneumatic cylinder 125 located near the pivot mounting of part 114 and having its piston rod 126 arranged to press the pins 120 into conically shaped recesses which occupy positions corresponding to pins 120 in the side of lug 118, as also shown in FIG. 9.

The buckle holder part 115 includes a plate member 129, having at one end a fixed member 130 with a groove for receiving one end edge of the buckle, and also slidably mounting a further grooved retainer member 132 which is urged towards member 130 by a spring 134. Members 130 and 132 are so arranged that when the device 26 is in its first, vertical position these members can receive between them the edges of a buckle which is pushed out of the magazine assembly by the blade 104. The spring 134 is sufficiently strong to hold the buckle firmly between members 130 and 132 while the device is pivoted by cylinder 112 from the first to the second postition. During this movement, the position of holder part 115 is locked by extension of the clinder 125. In its second position, the device 26 positions the buckle 12 adjacent the bed of the sewing machine 24.

The sewing machine 24 is a commercially available item known as a bar-tack machine and which is suitable for sewing of a zig-zag type of seam across a tape. For this purpose, the sewing machine includes special means for moving its bed 140 and its sewing foot 142 through a predetermined path of movement while the needle remains stationary. One small addition to the commercial sewing machine is a vertical pin 143 extending upwardly from the bed and passing through an aligned bore in foot 142. This pin is positioned just to the rear of the tape when sewn, and serves a purpose in preventing unwanted movement in a manner described in our copending U.S. Pat. application Ser. No. 679,424 (Case 1) aforesaid.

The left hand part of section C also includes locking device 31 which is a blade movable by a cylinder 31a which is mounted at the side of the sewing machine nearest the device 26, and is inclined downwardly from this side of the sewing machine towards the position occupied by the buckle when in the second position of device 26. Cylinder 31c is coupled to a parallel air blast tube 32. Locking device 31 has two prongs engageable with the edges of a tape inserted by picker 30 and which are spaced apart to straddle the clamping elements of the picker to hold the tape against the buckle and to prevent its withdrawal when the picker retracts. The air blast tube 32 causes the end of the tape, when free of the picker clamping elements, to be bent down towards the lower buckle slot when air is supplied to it. Also in this part of the machine is the blade 34, movable laterally by a pneumatic cylinder **34*a*, and which is aligned with the lower slot in the buckle when positioned as shown in FIG. 5*a*** and which is suitable for tucking an end of the tape back through this lower slot after bending of the tape by the air blast, and for positioning the free end of the tape under the main part of the tape and under the needle of the sewing machine for sewing.

Figure 1A:
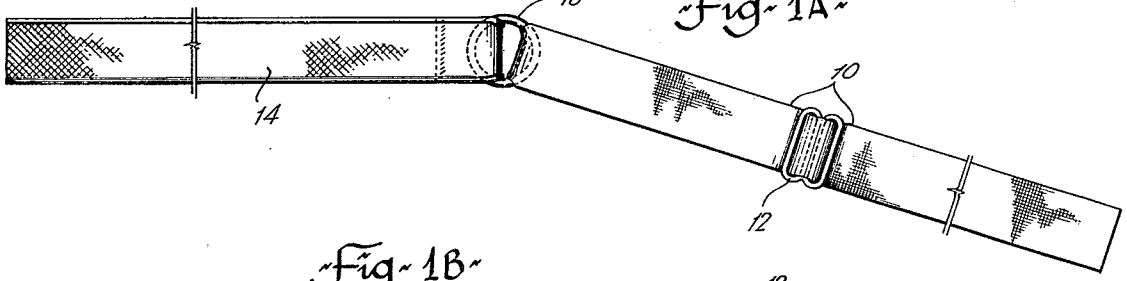
Figure 1B:
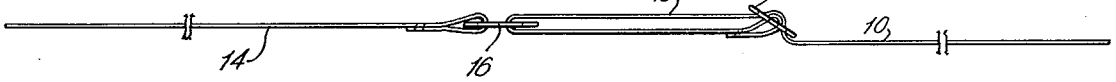
Figure 2:
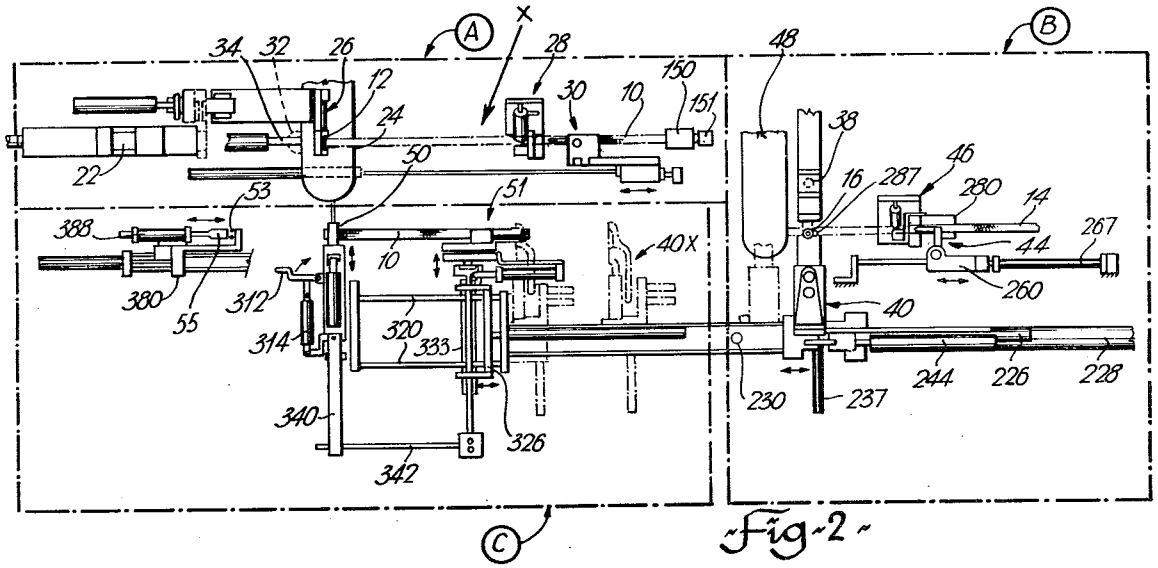
Figure 3A:
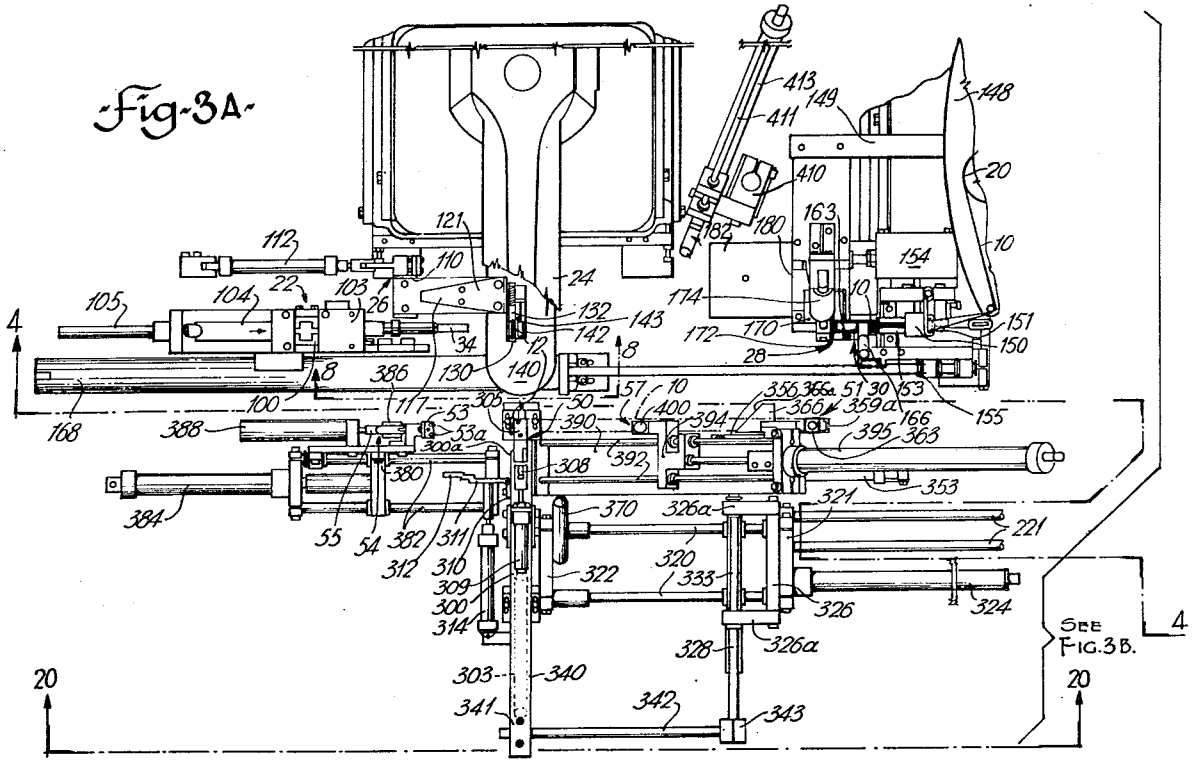
Figure 3B:
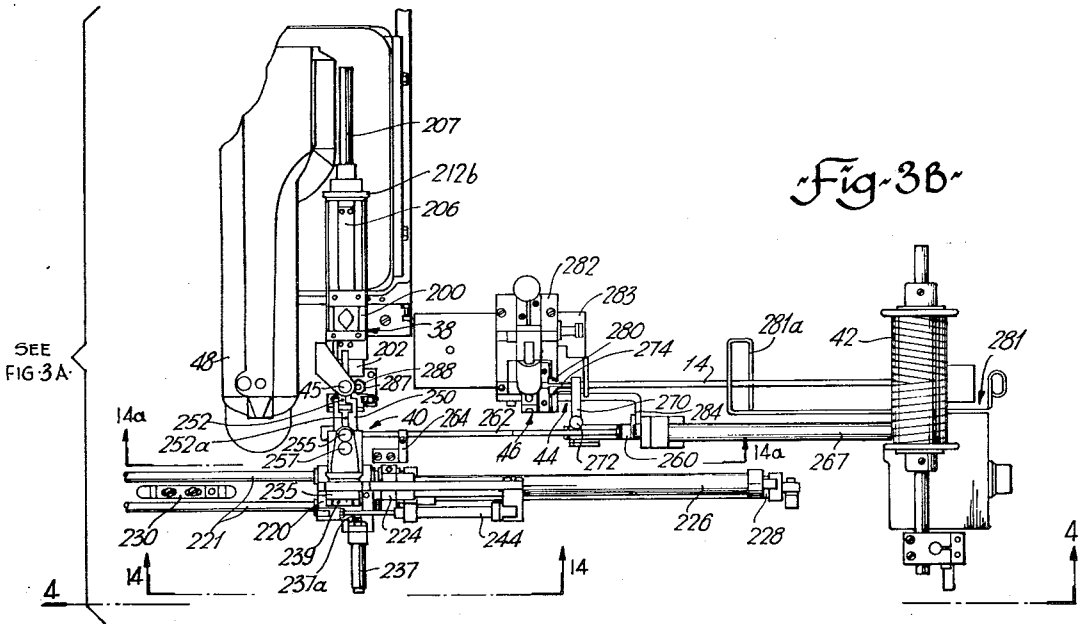
Figure 4A:
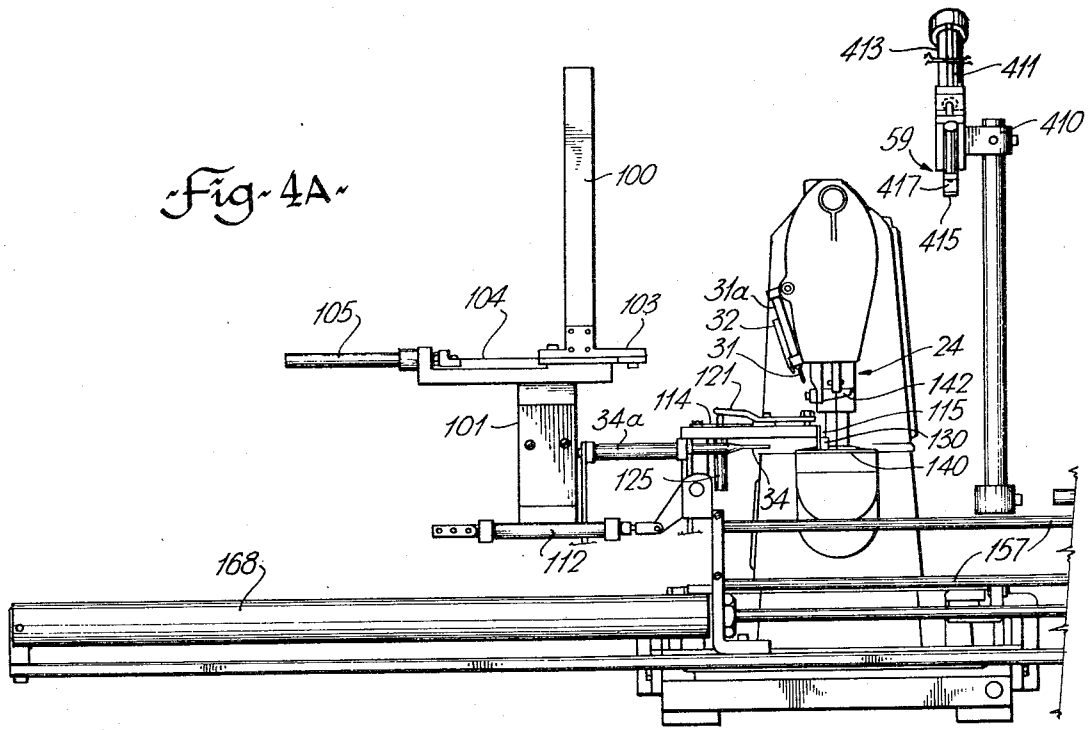
Figure 4B:
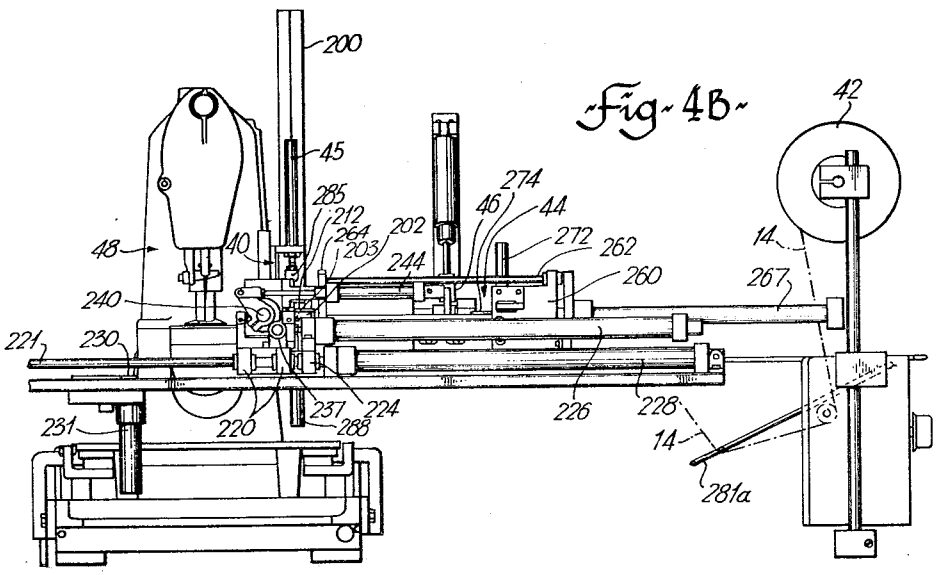
Figure 5:
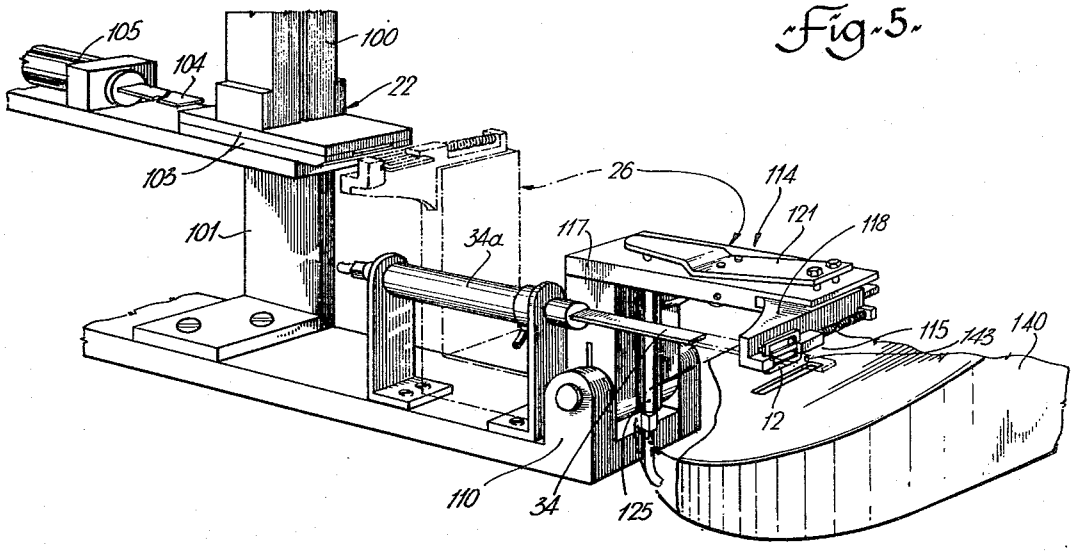
Figure 6:
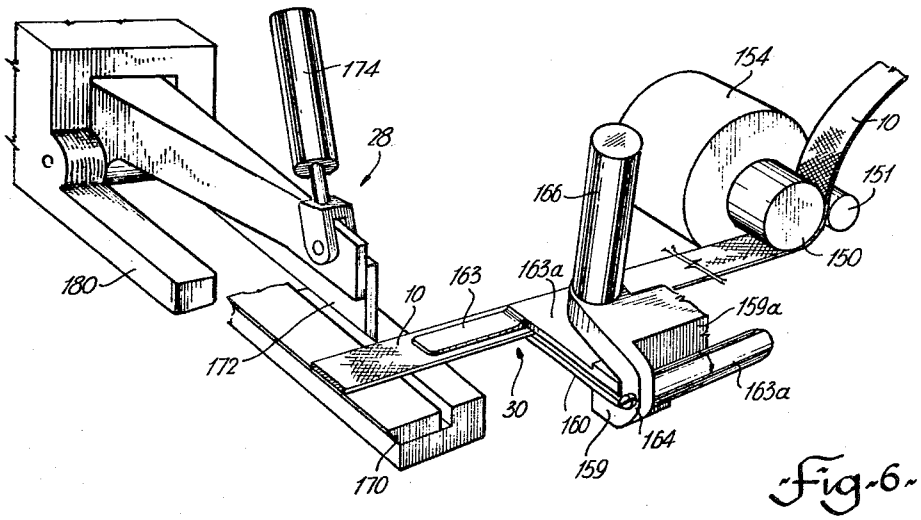

The right hand portion of section A will now be described with reference to FIG. 6, and also FIGS. 7 and 8.

The tape spool 20 is mounted above and to the rear of the machine on a spool holder 148 held by bracket 149, with the tape being led down through guides and then passed between a friction wheel 150 and a pressure roller 151, from which tape 10 passes horizontally under fingers 153 into picker 30 along a lateral path which is aligned with the buckle 12 in the sewing position. Friction wheel 150 is normally idle, but can be driven in such direction as to move the tape towards the right, for a purpose to be described.

The picker 30 comprises a carriage 155 movable on two vertically spaced, horizontal slide rods 157 which extend laterally, i.e. parallel to the desired path of tape movement from wheel 150 to the buckle in its sewing position. An arm 159 extends leftwards from carriage 155 and the front end of this carries a thin, flat member with a rearwardly extending part 160, and with a leftwards extending part 162. Part 162 cooperates with a similar upper member 163 carried by a part **163*a* which is pivotal relative to part 160 about pivot means indicated at 164. Part 163*a* is urged downwardly onto 162** by a piston rod of a pneumatic cylinder 166, which is mounted above part 163*a* on a fixed part 159*a* of the arm 159. Parts 162 and 163 together provide narrow projecting clamping elements capable of holding between them the free end of tape 10, and the thin, flat form of parts 160 and 162 allow these to advance the tape firstly over an anvil portion of the knife 28, and then through the upper slot of the buckle 12 held in the threading position by the device 26, elements 162 and 163 and the tape all passing through the slot. The necessary movement of the carriage 155 is provided by a pneumatic cylinder 168. The art 163*a* is spring urged upwardly, so that on release of pressure from cylinder 166 the picker can be withdrawn without withdrawing the tape. This arrangement is capable of accommodating various widths of tape.

The knife 28 operates with a scissors action, and includes a fixed anvil 170 having a horizontal surface just beneath the lowest surface of the picker element 162 (to allow this element to slide easily over the anvil), and the knife has a movable blade 172 pivotally attached to the rear of the anvil and movable by a pneumatic cylinder 174. The knife 28, spool holder bracket 149 with spool holder 148, and the friction wheel 150 and roller 151 and their associated mounting and driving means, are all mounted on a slidable mounting 180 which is adjustable in lateral position on a bed 182, the slidable mounting having a locking handle (not shown) for locking the mounting in a chosen position. Also, knife 28 carries a rightwards extension with a stop member 184 which engages the picker carriage 155 and provides a stop for this carriage which ensures that the picker clamping elements 162, 163 are suitably spaced on the right hand side of anvil 170 when the knife operates. With this arrangement, the length of the first strap portion can readily be adjusted by shifting the position of the mounting 180 on bed 182, the picker travel corresponding to the total length of tape used in the first strap portion and being regulated by the position of stop member 184.

Detailed descriptions of sections B and C of the machine, with which the present invention is not concerned, will be found in copending U.S. Pat. applications Nos. 679,424 and 679,425 filed concurrently herewith.

OPERATION

Operation of section A of the machine will now be described.

All the cylinders referred to above are pneumatic cylinders supplied with air through valves controlled by an automatic programmer, of the type sold under the trade name Agastate by AmeraceEsma Corporation, of the U.S.A.

Operations proceed simultaneously in sections A, B and C so that while a first strap portion is being formed in section B, section C is performing various buckling and associated operations which unite together two strap portions previously formed in sections A and B. Description of the operations in sections B and C will be found in our co-pending applications referred to above.

In section A, a cycle starts with the buckle holder and transfer device 26 in the vertical position, with cylinder 25 extended to cause pins 120 to lock the buckle holder part 115 in position, with knife 28 open, and with picker 30 retracted to its right hand position, and with the picker clamping elements 162 and 163 held closed by the cylinder 166.

Cylinder 105 is then extended so that blade 104 pushes a buckle from the magazine 100 into the buckle holder 115, and then cylinder 112 is retracted to rotate the device 26 into the threading position (FIGS. 8 and 9) in which the buckle is held vertically near the sewing foot and bed of the sewing machine 24. Simultaneously, cylinder 168 is retracted to advance the picker 30, the clamping elements 162 and 163 of the picker pulling tape 10 from the supply spool between friction wheel 150 and roller 151, which are idle at this stage, and final movement of the picker threads the tape through the upper slot in the buckle until about one-half inch of the tape extends through this slot (see FIG. 8). Friction wheel 150 is then briefly driven in the reverse direction to tighten the tape 10. Cylinder 31*a* is then extended to bring locking fork 31 into contact with the tape 10 and to hold a part of the tape against the central portion of the buckle, so that when the picker clamping elements have been released from the tape the picker can return to its initial position without pulling the tape from the buckle. Simultaneously, a blast of air from the tube 32 turns down the end of tape which projects through the buckle, and then cylinder 34*a* moves the blade 34 through the lower slot in the buckle, and then immediately retracts this blade, to tuck the free end of the tape through the lower slot and into a position adjacent to and underneath the main portion of the tape and in suitable position for being sewn thereto by the sewing machine 24. With locking fork 31 retracted, the sewing machine foot moves down to clamp the two layers of tape against the sewing machine bed. The cylinder 125 of the buckle holder and transfer device is then retracted to release the holding part 115 and to allow this to slide around while the tape clamped by the sewing foot is moved by the sewing machine as this sews a zig-zag seam. After sewing cylinder 125 is again extended to lock part 115, the sewing foot is raised, and the picker clamping elements are closed.

At this stage, the first strap portion is virtually complete, except that it is still connected to the supply of tape. This strap portion is severed from the tape supply by knife 28 after it has been clamped by clamping members 50 to 51, as fully described in U.S. Pat. application No. 679,424 (Case 1) aforesaid. The length of tape is determined by the position of knife 28 and the picker back-stop member 184 described above.

The embodiments of the present invention is which an exclusive property of privilege is claimed are defined as follows:

1. Apparatus for securing a two-slot buckle onto a tape including means for supplying horizontally disposed buckles to a delivery point, a pivotable buckle holding and transfer device arranged to receive said delivery point and pivotable through about a right angle to move the buckles from the delivery point to a threading position adjacent the operative part of a joining machine, in which threading position the buckles are disposed vertically, threading means for holding and advancing a free end of tape past the operative part of the joining machine and through one slot in the vertically held buckle, bending means for bending the said free end of the tape towards the other slot in the buckle, and blade means for pushing the free end of the tape through the other slot in the buckle and into a position adjacent the main part of the tape extending from the buckle, so that said adjacent parts of the tape are positioned in the operative part of the joining machine to allow said free end to be joined to the main part of the tape by said machine.

2. Apparatus according to claim 1, wherein said threading means includes a horizontally movable carriage supporting a pair of elongated clamping elements capable of holding the free end of the tape and advancing this through said one slot in the buckle.

3. Apparatus according to claim 2, wherein said carriage is movable from a retracted position to an advanced position, in which advanced position said clamping elements can extend through said one slot of the buckle when held by the holding and transfer device in the threading position, the travel of said carriage corresponding to the length of tape required to be attached to the buckle, the apparatus further comprising knife means operable when the threading means is in the retracted position to sever the tape at a point adjacent the end of the clamping elements nearest the holding and transfer device.

4. Apparatus according to claim 3, wherein said knife means is mounted on a slidable mounting adjustable in position towards and away from the holding and transfer device, said slidable mounting also including a stop co-operating with said movable carriage to limit travel of said movable carriage whereby the length of tape to be attached to the buckle is adjustable.

5. Apparatus according to claim 2, further comprising means for locking the free end of the tape against the buckle after the free end has been threaded through the buckle slot whereby the threading means can return to an initial position leaving the tape stationary in the buckle.

6. Apparatus according to claim 5, wherein said locking means includes two prongs engageable with the edges of a tape inserted through the one buckle slot to hold the tape against the buckle, said prongs being spaced apart to straddle the elongated clamping elements of the threading means.

7. Apparatus according to claim 1, wherein said bending means includes an air blast tube capable of directing an air blast at the free end of tape threaded through said one slot of the buckle.

8. Apparatus for securing a two-slot buckle onto a tape comprising:

a joining machine capable of receiving two horizontal layers of tape between a bed and a movable foot, means for supplying horizontally disposed buckles to a delivery point, a pivotable buckle holding and transfer device arranged to receive said buckles at said delivery point and pivotable through about a right angle to move the buckles from the delivery point to a threading position adjacent the operative part of, the joining machine between said bed and the foot, whereby the buckles are disposed vertically in said threading position, threading means including elongated clamping elements movable to advance a free end of the tape endwise firstly between the foot and bed of the joining machine and then endwise through one slot in the vertically held buckle, bending means for bending the said free end of the tape towards the other slot in the buckle, and blade means for pushing the free end of the tape through the other slot in the buckle and into a position between the bed and sewing foot of the joining machine to allow said free end of the tape to be joined to a main portion thereof by said machine.

9. Apparatus according to claim 8, wherein said joining machine is a sewing machine having a bed and sewing foot which move relative to a stationary needle during sewing, and wherein said buckle holding and transfer device includes a releasable holding part for the buckle which part is releasable to move with the bed and sewing foot, said buckle holding and transfer device and said threading means being clear of direct contact at all times with the sewing machine bed and foot.

10. A method for securing a two-slot buckle onto a tape comprising the steps of:

horizontally feeding a horizontally disposed buckle to a buckle holding and transfer device, rotating said buckle through about a right angle and simultaneously moving said buckle to a position near the operative part of a joining machine, threading tape endwise through the operative part of the joining machine and through one slot in the buckle, bending the free end of the tape towards the other slot of the buckle, tucking the free end of the tape through the other slot of the buckle to overlap the main length of tape in the operative part of the joining machine, and operating said joining machine to join together the overlapping tape parts.

* * * * *